US006116889A

United States Patent [19]

Pagel et al.

[11] Patent Number: 6,116,889

[45] Date of Patent: Sep. 12, 2000

[54] ROTARY PRESS

[75] Inventors: Jürgen Pagel; Michael Matthes, both of Berlin, United Kingdom

[73] Assignee: Korsch Pressen GmbH, Germany

[21] Appl. No.: 09/010,524

[22] Filed: Jan. 21, 1998

[30] Foreign Application Priority Data

Jan. 31, 1997 [DE] Germany ..... 197 05 094

[51] Int. Cl.[7] ..... B30B 11/08

[52] U.S. Cl. ..... 425/345; 425/211

[58] Field of Search ..... 425/344, 345, 425/211, 193

[56] References Cited

U.S. PATENT DOCUMENTS

| | | | |
|---|---|---|---|
| 2,997,741 | 8/1961 | Crossley | 425/345 |
| 3,347,502 | 10/1967 | Gwinn, Jr. . | |
| 3,566,806 | 3/1971 | Forster et al. | 425/345 |
| 3,625,466 | 12/1971 | Marshall et al. . | |
| 3,891,375 | 6/1975 | Pilewski et al. | 425/345 |
| 4,053,266 | 10/1977 | Friedricks . | |
| 4,729,859 | 3/1988 | Munsey et al. | 425/125 |
| 5,612,065 | 3/1997 | Keller | 425/356 |

FOREIGN PATENT DOCUMENTS

| | | |
|---|---|---|
| 0 122 951 A1 | 10/1984 | European Pat. Off. . |
| 1 272 175 | 8/1960 | France . |
| 1378044 | 10/1964 | France . |

OTHER PUBLICATIONS

Werner A. Kral, Ing., Feb. 1986, "Schwingungsdämpfung—Auffangenzerstörender Kräfte", *Technica* Feb. 1986.

*Primary Examiner*—James P. Mackey
*Attorney, Agent, or Firm*—McGlew and Tuttle, P.C.

[57] ABSTRACT

A rotary press, especially for preparing tablets, with a frame, a rotor with drive, at least one pressure roller unit, and a housing. To improve the absorption of the forces introduced into the pressure roller unit, of which there is at least one, and to design the rotary press as a low-vibration and low-noise press, a massive base plate (1) accommodating the rotor (2) with the drive and the pressure roller unit (3) is supported by the base frame (6) by elastic mounts (7). The rigidity of the elastic mounts (7) and the mass of the assembly unit formed by the rotor (2) with the drive and the pressure roller unit (3), of which there is at least one, are coordinated with one another such that the natural frequency of this vibration system in all six possible degrees of freedom is substantially lower than the lowest punch engagement frequency occurring at the lowest speed of rotation, which is the excitation frequency.

12 Claims, 4 Drawing Sheets

ROTARY PRESS

FIELD OF THE INVENTION

The present invention pertains to a rotary press, especially for preparing tablets, with a frame, a rotor with drive, at least one pressure roller unit, and a housing.

BACKGROUND OF THE INVENTION

Rotary presses, which comprise a frame, a rotor with drive, upper and lower rockers, which guide the upper and lower pressure rollers, a frame housing, corner connections and a cover plate, have been known. The forces occurring during the pressing process are directly introduced via the punches and the rockers into the cover plate and the frame and they induce vibrations in these membrane-like components due to the pressing forces, and these vibrations thus lead to considerable noise emissions.

A rotary press of this type has been known from U.S. Pat. No. 3,891,375. The base frame consists here of a rectangular frame, on the top frame plate of which the rotor is mounted. The housing comprises beams, which are bolted to the frame and carry a control unit above the rotor. The pressure roller units have a frame-like design and are mounted at lateral beams bolted to the frame.

The drawback is that the pressing forces of the two pressure roller units are absorbed by the beams forming the housing, as a result of which deformations of the housing and consequently vibrations and noises of the housing are generated under high loads.

SUMMARY AND OBJECTS OF THE INVENTION

The primary object of the present invention is therefore to improve a rotary press of this type such that the absorption of the forces introduced into the pressure rollers is improved and the rotary press operates at a lower vibration and noise level.

To accomplish this object, the present invention provides for a massive, rigid and twisting-resistant base plate accommodating the rotor with the drive being carried by the base frame by means of elastic mounts, and the rigidity of these elastic mounts and the mass of this complete press cell are coordinated with one another such that the natural resonance frequency of this vibration system is substantially lower in all six possible degrees of freedom than the lowest punch engagement frequency occurring at the lowest speed of rotation, which is the excitation frequency. As a result, the complete press cell is excited supercritically during the pressing process. The dynamic forces and moments acting from the pressure rollers on the pressure roller unit and the dynamic forces and moments of the rotor drive are thus absorbed almost exclusively by the massive base plate, which is mounted on the base frame by means of the elastic mounts. Dynamic forces from the pressing process hardly act on components of the rotary press not arranged on the base plate. Thus, the tabletting press operates at a low vibration and noise level and is yet able to transmit strong pressing forces.

The housing enclosing the rotor with the drive, the pressure roller unit, the massive base plate and the base frame is connected exclusively to the base frame and is supported against the base plate by means of smaller elastic mounts, wherein the rigidity of the elastic mounts is selected to be such that the natural frequency resulting from the connected mass and the rigidity of the elastic mounts is substantially lower than the lowest punch engagement frequency. Thus, hardly any vibrations and consequently hardly any noises are transmitted from the parts excited by the pressing forces to vibrate, such as the rotor with drive and pressure roller unit, to the housing.

The housing is designed such that the part of this housing accommodating the upper head part of the press extends over the entire height of the press and limits the press on one vertical side.

This housing segment is preferably used to receive the main electric drive, the arriving and outgoing connection lines, the supply units and the supply lines of the machine. A wall separates this supply side of the rotary press from the clean room side of the press cell.

The elastic mounts are preferably designed as two metallic mounting elements and an elastic buffer connecting same. Such elastic mounts are commercially available under the trademark SCHWINGMETALL from the firm of Continental.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
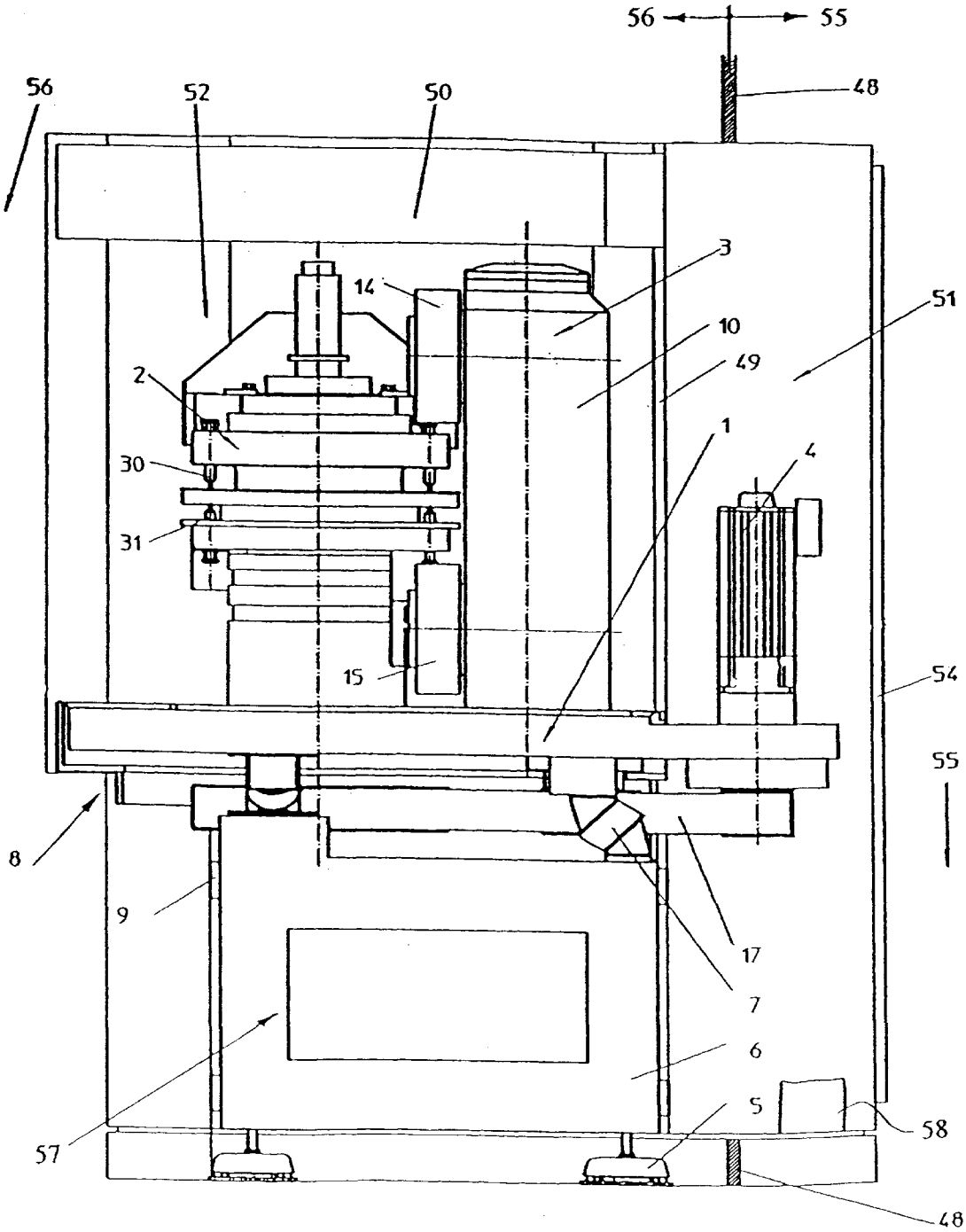
FIG. 1 is a general view of the rotary tabletting press.

Referring to the drawings in particular, the invention comprises a rotary press with a massive, rigid and twisting-resistant base plate 1. A rotor 2, a pressure roller unit 3, and a drive motor 4 are mounted on the massive base plate 1. A base frame 6 is provided which stands on elastic feet 5 and on which the massive base plate 1 is mounted by means of elastic mounts 7. A housing 8 surrounds these components and is connected to the base frame 6 by means of smaller elastic mounts 9.

Figure 2:
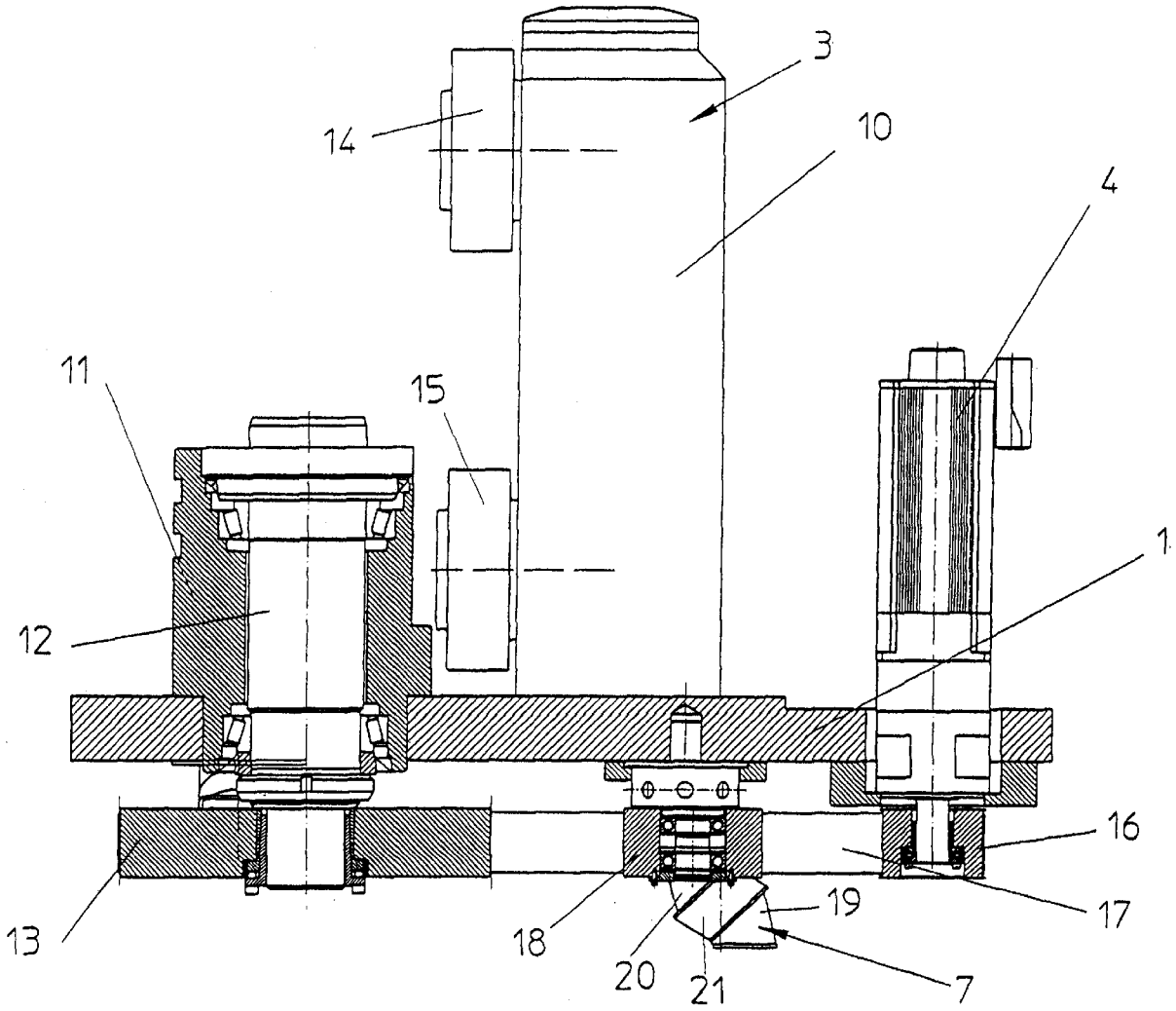
FIG. 2 is a vertical sectional view through the massive base plate of the rotary tabletting press with rotor drive and pressure roller unit.

As is shown in FIG. 2, a bearing bush 11 is arranged on the massive base plate 1 for the axle 12 of the rotor 2, not shown here. The axle 12 of the rotor 2 carries a toothed belt pulley 13 on the underside of the base plate 1. The pressure roller unit 3 with upper and lower pressure roller 14, 15 is adjustably mounted next to the bearing bush 11 for the rotor 2. Next to it is located the drive motor 4 fastened to the massive base plate 1 with toothed belt pinion 16 located on the underside, wherein a toothed belt 17 is laid around the toothed belt pulley 13 for the rotor 2 and the toothed belt pinion 16 and is tightened by a tightening disk 18.

Four elastic mounts 7 support the massive base plate 1 on the base frame 6 shown in FIG. 1. The elastic mounts 7 are formed by two metallic mounting elements 19, 20 and an elastic buffer 21 connecting same. The elastic mounts 7 are commercially available under the trademark SCHWING-METALL from the firm of Continental.

Figure 3:
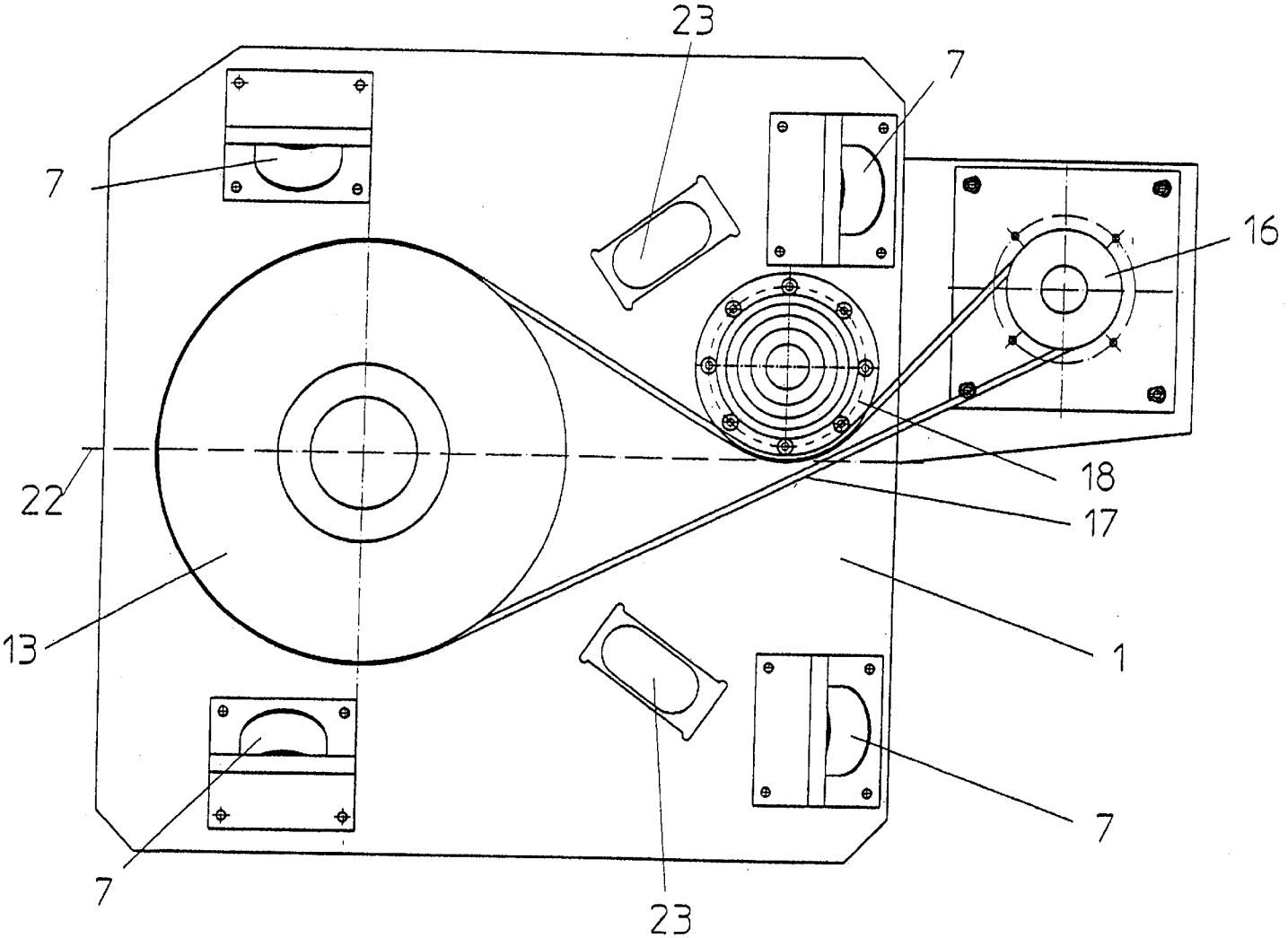
FIG. 3 is a bottom view showing the underside of the massive base plate with rotor drive.
Figure 4:
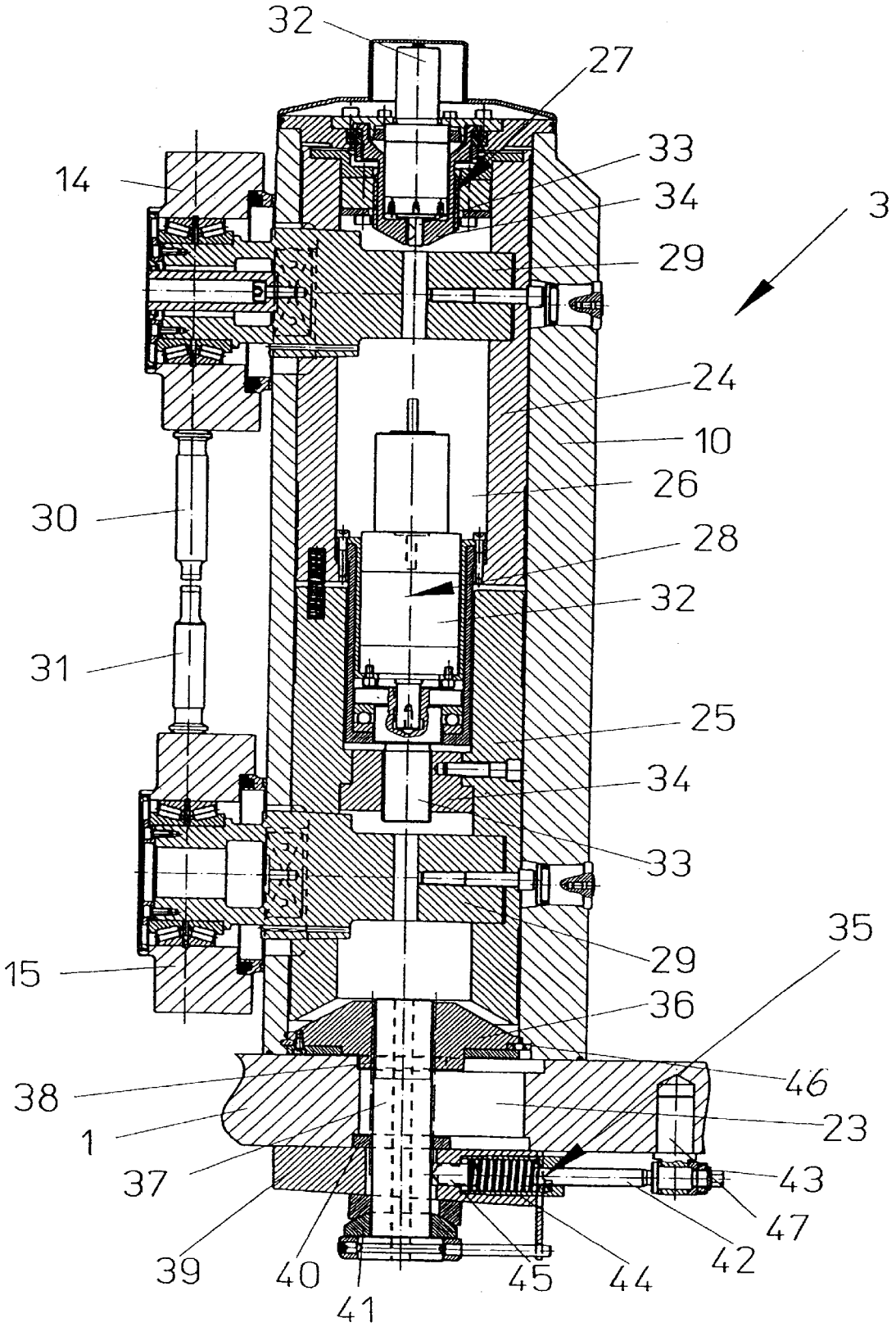
FIG. 4 is a vertical cross sectional view taken through the pressure roller unit.

FIG. 3 shows the bottom view of the massive, rigid and twisting-resistant base plate 1 with the four elastic mounts 7, with the toothed belt pulley 13 driving the rotor 2, with the toothed belt pinion 16 driven by the drive motor 4, and with the tightening disk 18 tightening the toothed belt 17. Elongated holes 23, which are used to receive and mount a pressure roller unit 3 each, which will be described in greater detail below on the basis of FIG. 4, extend at an angle of about 35° to the longitudinal axis 22 of the base plate 1.

The pressure roller unit 3 of the rotary press comprises a massive guide column 10 of a cylindrical cross section, in the cylindrical inner space 26 of which a likewise cylindrical and hollow, upper pressure roller mount 24 and a cylindrical and internally hollow, lower pressure roller mount 25 are mounted slidingly, wherein the upper and lower pressure roller mounts 24, 25 likewise have a massive and stable design. An adjusting drive 27 for the upper pressure roller 14 is arranged in the upper area of the guide column 10, and an adjusting drive 28 for the lower pressure roller 15 is arranged in the middle area of the guide column 10. The upper adjusting drive 27 is used to set the upper pressure roller 14 and thus the depth of penetration of the upper punch 30 acted on by the upper pressure roller 14 and for the joint, i.e., parallel adjustment of the upper and lower pressure rollers 14 and 15, respectively, with a fixed distance, and consequently for adjusting the pressing zones. The adjusting drive 28 for the lower pressure roller 15 is used to set the tablet thickness relative to the upper pressure roller 14.

The two adjusting drives 27, 28 comprise a gear motor 32 each with drive spindle 33, which engages a spindle nut 34, which is rigidly connected to the pressure roller mount 24, 25. As a result, the upper pressure roller mount 24 can be moved adjustably with the pressure roller axle 29 for the upper pressure roller 14 and the lower pressure roller mount 25 can be moved adjustably with the pressure roller axle 29 for the lower pressure roller 15 within the guide column 10.

The pressure roller unit 3 is mounted vertically with its guide column 10 on the massive base plate 1 and is movable by means of the horizontally operating adjusting drive 35. A truncated cone-shaped mounting flange 36 is fixed within the lower end of the guide column 10 by means of three ring segments 46 distributed over the circumference. A tie rod 37 is screwed within the central axis of the guide column 10 in the mounting flange 36, and the tie rod 37 passes through a projection 38 at the lower end of the truncated cone-shaped mounting flange 36, which projection 38 is movable within an elongated hole 23, which is provided in the massive base plate 1. The tie rod 37 is penetrated under the base plate 1 by the wedge 39 within the stop ring 40, which is held by means of a dome-shaped piece 41 by the T-shaped head of the tie rod 37. The wedge 39 can be loosened and tightened by means of a threaded spindle 42, which is located rotatably and horizontally nondisplaceably at the free end in a vertical bolt 47 fixed in the base plate 1. For locking, the threaded spindle 42 is rotated at a spindle head 43 until the projection 38 of the mounting flange 36 and the stop ring 40 come into contact with the left-hand end of the elongated hole 23. The spindle 42 now presses the tip 45 against the tie rod 37 under the action of a compression spring 44. Furthermore, the wedge 39 is displaced to the left such that the guide column 10 becomes firmly seated on the top side of the base plate 1 of the rotary tabletting press by means of the tie rod 37.

To pull the pressure roller unit 3 and thus the pressure rollers 14, 15 forward from the engagement area of the upper and lower punches 30 and 31, respectively, the threaded spindle 42 is rotated in the opposite direction by means of the spindle head 43, the compression spring 44 is released, and the wedge 39 is moved out of the stop ring 40 by a small amount, so that the guide column 10 is released from its fixed tensioning at the base plate 1 and can be pulled to the right by continuing to actuate the threaded spindle 42.

FIG. 1 shows a partition 48, which extends on the left under the base plate 1 and next to the base frame 6 and on the right behind the pressure roller unit 3, and which surrounds the housing 8 sealingly on all sides. The partition 48 may be a building wall and makes it possible to divide the rotary press into a supply area 55 located both on the right of the partition 48 in FIG. 1 with a multifunction column 51 and also located under the base plate 1, and a clean room area 56 located above the base plate 1 with the press cell formed by the rotor 2 and the pressure roller unit 3.The multifunction column 51 can house the drive 4 and supply components 58. The clean room area of the press cell is separated from the supply area by the base plate 1, the wall 49 of the multifunction column 51 shown on the left in FIG. 1, the head piece 50 and the partition 48. The supply area can thus be used independently from the clean room area to operate the mechanical and electric drives and supply units located on the underside and rear side of the rotary press outside the clean room. The supply area 56 includes at least one press room 52, which then includes the rotor 2 pressure roller unit 3 and base plate 1 for the press. The energy may be supplied to the rotary press from the top or from the bottom directly into the multifunction column.

The base frame 6, the column 51 and the head piece 50 form the press housing 8, in which openings are located, e.g., for the belt drive. The interior space of the column 51 is accessible for maintenance and/or cleaning operations from the supply area/technical area 55 through one or more doors 54.

Not only the working area 32, but also the production area 56 in which the overwhelming part of the press is located, is a clean room area.

If the press is built into a wall 48 of a production area 56 with its rearside formed, e.g., by the wall 49 of the multifunction column 57, such that part of the multifunction column 51 extends into the adjoining supply area/technical area 55 (through-the-wall technology) the area that is the left-hand area when viewed from the wall 48 forms the clean production area 56 and the right-hand area forms the supply area/technical area 55.

While a specific embodiment of the invention has been shown and described in detail to illustrate the application of the principles of the invention, it will be understood that the invention may be embodied otherwise without departing from such principles.

APPENDIX

LIST OF REFERENCE NUMBERS

1 Base plate
2 Rotor
3 Pressure roller unit
4 Drive motor
5 Elastic foot
6 Base frame
7 Elastic mount
8 Housing
9 Small elastic mount
10 Guide column

11 Bearing bush
12 Axle 51 Multifunction column
13 Toothed belt pulley
14 Pressure roller, upper
15 Pressure roller, lower
16 Toothed belt pinion
17 Toothed belt
18 Tightening disk
19 Mounting element
20 Mounting element
21 Buffer
22 Longitudinal axis
23 Elongated hole
24 Upper pressure roller mount
25 Lower pressure roller mount
26 Inner space
27 Upper adjusting drive
28 Lower adjusting drive
29 Pressure roller axle
30 Upper punch
31 Lower punch
32 Gear motor
33 Drive spindle
34 Spindle nut
35 Horizontal adjusting drive
36 Mounting flange
37 Tie rod
38 Projection
39 Wedge
40 Stop ring
41 Dome-shaped piece
42 Threaded spindle
43 Spindle head
44 Compression spring
45 Tip
46 Ring segment
47 Bolt
48 Partition
49 Wall
50 Head piece
51 Multifunction column

What is claimed is:

1. A rotary tablet forming press, comprising:

a base frame;

a rotor with a drive;

a pressure roller unit with punch elements engaging with said rotor and having a punch engagement frequency based on a speed of rotation of said rotor;

elastic mounts on said base frame; and a base plate mounted on said elastic mounts, and on a side of said elastic mounts opposite said base frame, said base plate mounting said rotor with said drive and said pressure roller unit, said elastic mounts having a rigidity, said rigidity and a mass consisting of said base plate with said rotor and said drive and said pressure roller unit are coordinated with one another such that a natural frequency of a resulting vibration system is lower in all six possible degrees of freedom than a lowest punch engagement frequency occurring at a lowest speed of rotation, which is an excitation frequency.

2. The rotary press in accordance with claim 1, further comprising a housing enclosing said rotor with said drive, and said pressure roller unit is mounted on said base plate.

3. The rotary press in accordance with claim 1, wherein said elastic mounts are designed as elastomer bonded to metal.

4. The rotary press in accordance with claim 2, wherein said housing is divided by means of a partition into a clean room area and a supply area, said clean room area including essentially said rotor and said pressure roller unit, said supply area is located within said base frame and a multifunction column which contains said drive of said rotor and supply components relevant for maintenance of the press.

5. The rotary press in accordance with claim 4, wherein said drive includes a drive motor and a toothed belt drive accessible from outside said clean room.

6. The rotary press in accordance with claim 4, wherein said rotary press is arranged in a building room in which predetermined requirements are imposed in terms of cleanness, wherein said supply area extends into an adjoining maintenance room of the building through an opening in the building room.

7. The rotary press in accordance with claim 1, wherein said elastic mounts are metal/rubber/metal sandwich vibration components.

8. The rotary press in accordance with claim 1, wherein:

each of said elastic mounts include an elastic buffer with mounting elements on substantially opposite sides of said elastic buffer.

9. A rotary tablet forming press, comprising:

a base frame;

elastic mounts on said base frame;

a base plate mounted on said elastic mounts;

a rotor mounted on said base plate, said rotor including a plurality of punches;

a pressure roller unit mounted on said base plate and engaging with said punches of said rotor, interaction of said punches and said pressure roller unit generating a punch engagement vibration;

a drive rotating said rotor, a speed of said drive determining a punch engagement frequency of said punch engagement vibration, said base plate and all structure connected to said base plate having a mass, said mass and said elastic mounts forming a vibration system with a natural frequency below said punch engagement frequency.

10. The press in accordance with claim 9, wherein:

said vibration system has six degrees of freedom and said natural frequency in all of said six degrees of freedom is below said punch engagement frequency.

11. The press in accordance with claim 9, wherein:

said mass of said vibration system includes all structure connected to said elastic mounts on a base plate side of said elastic mounts.

12. The press in accordance with claim 9, wherein:

said mass of said vibration system includes a mass of said rotor, said pressure roller unit, and said drive.

* * * * *